US009689302B2

(12) United States Patent
Fischer et al.

(10) Patent No.: US 9,689,302 B2
(45) Date of Patent: Jun. 27, 2017

(54) EXHAUST MANIFOLD

(71) Applicant: BENTELER AUTOMOBILTECHNIK GMBH, Paderborn (DE)

(72) Inventors: Uwe Fischer, Bad Arolsen (DE); Elmar Grussmann, Altenbeken-Buke (DE); Tobias Gockel, Meschede (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 14/866,041

(22) Filed: Sep. 25, 2015

(65) Prior Publication Data

US 2016/0090890 A1 Mar. 31, 2016

(30) Foreign Application Priority Data

Sep. 26, 2014 (DE) ..... 10 2014 114 002

(51) Int. Cl.

| | |
|---|---|
| ***F01N 13/18*** | (2010.01) |
| ***F01N 13/10*** | (2010.01) |
| ***F01N 1/24*** | (2006.01) |
| ***F01N 13/14*** | (2010.01) |

(52) U.S. Cl.

CPC ..... *F01N 13/18* (2013.01); *F01N 1/24* (2013.01); *F01N 13/10* (2013.01); *F01N 13/102* (2013.01); *F01N 13/14* (2013.01); *F01N 13/1811* (2013.01); *F01N 13/1872* (2013.01); *F01N 13/1888* (2013.01); *F01N 2260/08* (2013.01);

(Continued)

(58) Field of Classification Search

CPC ..... F01N 13/10; F01N 13/102; F01N 13/107; F01N 13/0805; F01N 13/1872; F01N 13/141; F01N 3/046

USPC ..... 60/323

See application file for complete search history.

(56) References Cited

U.S. PATENT DOCUMENTS

| | | | |
|---|---|---|---|
| 3,653,205 | A | 4/1972 | Tadokoro |
| 5,729,975 | A | 3/1998 | Bekkering |
| 6,789,386 | B1 | 9/2004 | Haerle |

(Continued)

FOREIGN PATENT DOCUMENTS

| | | | | |
|---|---|---|---|---|
| DE | 19909934 | C1 * | 1/2001 | ..... F01N 13/102 |
| DE | 10102637 | A1 | 7/2002 | |

(Continued)

OTHER PUBLICATIONS

Machine Translation of WO 02073010, Translated on Aug. 31, 2016.*

Machine Translation of DE 19909934, Translated on Aug. 31, 2016.*

*Primary Examiner* — Patrick Maines

(74) *Attorney, Agent, or Firm* — Hauptman Ham, LLP

(57) ABSTRACT

An exhaust manifold for an exhaust system of an internal combustion engine is disclosed having a housing, an inlet flange which can be fixed to the cylinder head of the internal combustion engine and has a plurality of inlet openings, and an exhaust outlet. The housing comprises an inner shell and an outer shell, an insulating material being incorporated between the outer shell and the inner shell. A guide plate is provided on the inlet flange side of the inner shell and the outer shell. The guide plate has inflow openings which correspond with the inlet openings of the inlet flange and is joined to the inlet flange. The outer shell engages with its inlet flange-side edge around the guide plate and is joined to the inlet flange and the guide plate.

11 Claims, 5 Drawing Sheets

Figure 1:
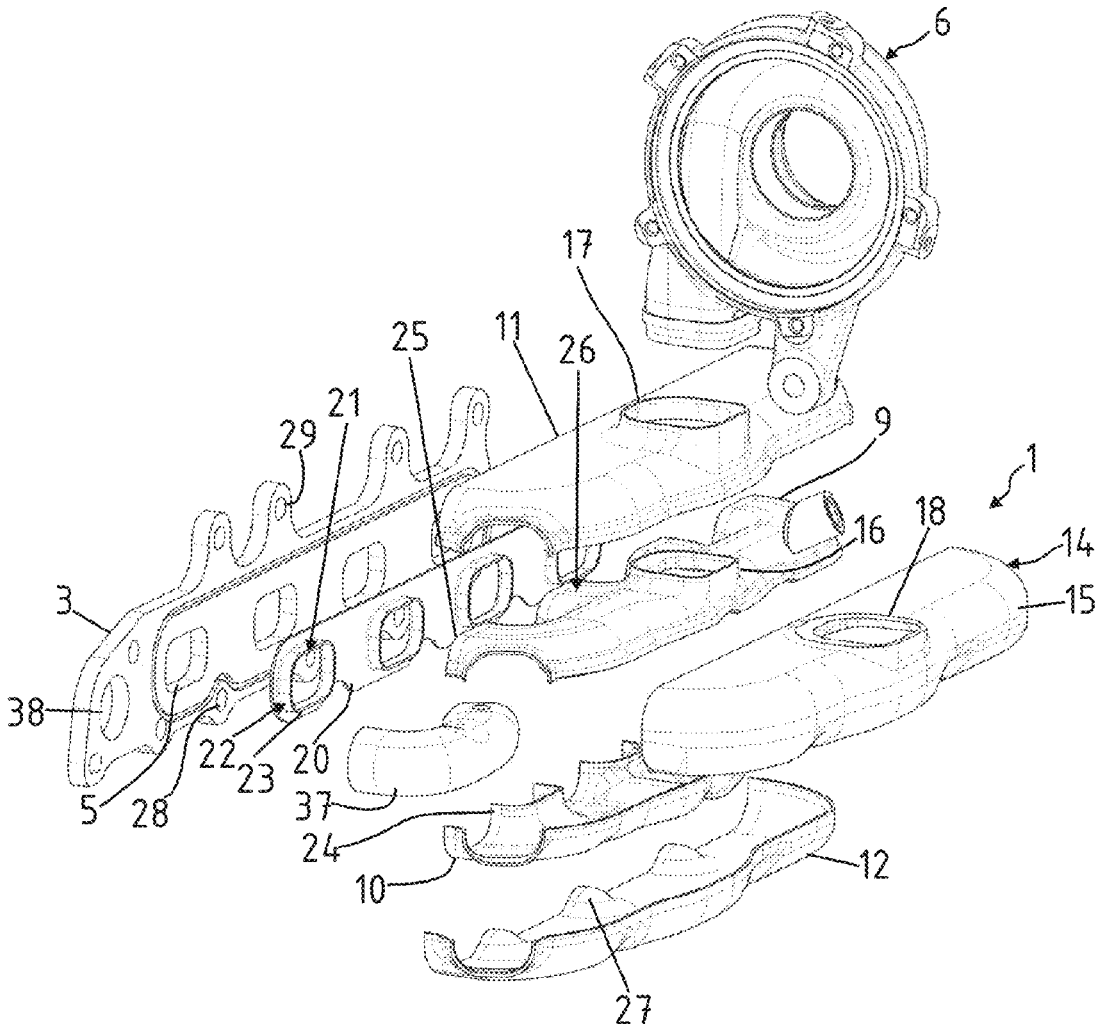

(52) U.S. Cl.
CPC ..... *F01N 2260/10* (2013.01); *F01N 2450/22* (2013.01)

(56) References Cited

U.S. PATENT DOCUMENTS

| | | | | |
|---|---|---|---|---|
| 2002/0174650 | A1* | 11/2002 | Durr | F01N 13/102 60/323 |
| 2003/0024299 | A1* | 2/2003 | Fujita | F01N 13/008 73/23.31 |
| 2005/0183414 | A1* | 8/2005 | Bien | F01N 13/10 60/323 |

FOREIGN PATENT DOCUMENTS

| | | | | |
|---|---|---|---|---|
| DE | WO 02073010 | A2 * | 9/2002 | F01N 13/10 |
| DE | EP 1329607 | A2 * | 7/2003 | F01N 13/10 |
| DE | 10359060 | A1 | 7/2005 | |
| DE | 10359062 | A1 | 7/2005 | |
| DE | 102004058998 | A1 | 6/2006 | |
| DE | 202007015606 | U1 | 3/2009 | |
| DE | WO 2009059688 | A1 * | 5/2009 | F01N 13/08 |
| DE | 102013101634 | A1 | 5/2014 | |
| EP | 0671551 | A1 | 9/1995 | |
| EP | 1206631 | A1 | 5/2002 | |
| EP | 1206631 | B1 | 5/2002 | |
| EP | 2207950 | A1 | 7/2010 | |
| EP | 2207950 | B1 | 7/2010 | |
| EP | 2450543 | A1 | 5/2012 | |
| JP | H09242537 | A | 9/1997 | |
| JP | H10266845 | A | 10/1998 | |
| WO | 0111209 | A1 | 2/2001 | |
| WO | 2009059688 | A1 | 5/2009 | |

* cited by examiner

EXHAUST MANIFOLD

RELATED APPLICATIONS

The present application claims priority from German Application Number 102014114002.8, filed Sept. 26, 2014, the disclosure of which is hereby incorporated by reference herein in its entirety.

The invention relates to an exhaust manifold for an exhaust system of an internal combustion engine in accordance with the features in the preamble of claim 1.

An exhaust manifold is a component of an exhaust system of combustion engines, in particular of internal combustion engines in motor vehicles. Fixed directly to the cylinder head of the internal combustion engine, the exhaust manifold serves to collect the exhaust gas which exits from the individual cylinders and to feed it to an exhaust outlet. An exhaust manifold is therefore frequently also called an exhaust collector.

U.S. Pat. No. 5,729,975 A has added an air gap-insulated exhaust manifold to the prior art. Said air gap-insulated exhaust manifold has an inner pipe system, an outer shell which surrounds the inner pipe system at a spacing, and an inlet flange and an outlet flange. The exhaust manifold which is known from DE 101 02 637 A1 also has an inner pipe system, configured there as an inner shell, which is surrounded by an outer shell, with the result that an air gap is formed between the inner shell and the outer shell. Inlet flanges with inlet openings are provided on the exhaust inlet side. The exhaust gases which flow in via the inlet flanges are combined onto a common outlet flange on a middle section of the exhaust manifold.

EP 2 207 950 B1 has disclosed an air gap-insulated exhaust manifold which consists substantially of three components, namely an outer shell, an inner shell and a flange which can be fixed to the cylinder head of the internal combustion engine. The outer shell and the inner shell are in each case of hood-shaped configuration and have in each case one circumferential collar, the outer shell collar being connected to the flange and the inner shell collar being clamped in between the outer shell collar and the flange. In order to bring about said clamping action, a plurality of lug-shaped or undulating bulges are formed on the inner shell collar, which are supported in a punctiform manner against the outer shell collar and/or the flange.

EP 1 206 631 B1 discloses an exhaust manifold having an exhaust collecting housing for receiving exhaust gas from the cylinder head, which exhaust manifold has a gasket device which is arranged between the exhaust collecting housing and the cylinder head. The exhaust collecting housing is provided with recesses in such a way that it can be connected directly to the cylinder head via fastening means, movements which are caused by the action of heat being possible between the exhaust collecting housing and the cylinder head. Here, the additional gasket device between the outer system and exhaust collecting housing and the fixing via the fastening means are complicated.

Furthermore, DE 103 59 062 A1 has added a so-called hood manifold to the prior art. Said manifold has at least one collecting pipe and at least one hood. Here, the collecting pipe is assembled from two half shells and is enclosed by the hood.

In the exhaust manifold which is known from JP H10-266 845 A, the inflow ports of the inner shell are either connected directly to the inlet openings in the inlet flange of the exhaust manifold or via in each case individual connecting ports.

Exhaust manifolds of thin-walled construction have the advantage that the thermal mass and therefore the response behavior of a catalytic converter which is connected downstream is improved after cold starting. Furthermore, air gap-insulated exhaust manifolds have the advantage that the heat losses of the exhaust gas on the way to the catalytic converter are reduced by way of the insulating action of the air gap, as a result of which rapid heating or rapid reaching of the operating temperature of the catalytic converter after cold engine starting is brought about.

In the case of constructed air gap-insulated exhaust manifolds, the inner system is as a rule welded to the inlet flange. The individual pipe components of the inner system are separated by sliding seats, in order to avoid thermal stresses in the inner system. The inner system conducts the gas. The outer system assumes the load-bearing function and represents a gas-tight cover.

Proceeding from the prior art, the invention is based on the object of functionally improving an exhaust manifold with a simple construction and, in particular, of designing the inner system simply and advantageously compensating for thermal expansions of the inner system relative to the outer system.

According to the invention, this object is achieved in an exhaust manifold in accordance with the features of claim 1.

Advantageous refinements and developments of the exhaust manifold according to the invention are the subject matter of dependent claims 2 to 11.

The exhaust manifold has a housing, an inlet flange which can be fixed to the cylinder head of the internal combustion engine and has a plurality of inlet openings, and an exhaust outlet. The housing comprises an inner shell and an outer shell, an insulating material being incorporated between the outer shell and the inner shell. According to the invention, a guide plate is provided on the inlet flange side of the inner shell and the outer shell, which guide plate has inflow openings which correspond with the inlet openings of the inlet flange, and is joined to the inlet flange. The outer shell engages with its inlet flange-side edge around the guide plate and is joined to the latter and the inlet flange. Furthermore, the guide plate has positioning elements for positioning the inner shell. The inner shell is mounted in a floating manner relative to the guide plate and the outer shell.

The inner system of the exhaust manifold comprises an inner shell. The inner shell is assembled from two shell parts, in particular an upper shell and a lower shell. The outer system of the exhaust manifold consists of the outer shell. Said outer shell is also preferably assembled from at least two shell parts, in particular an upper shell and a lower shell. Outlet openings which correspond to one another and form the exhaust outlet are configured in the inner shell and the outer shell or in shell parts of them and also in the insulating material.

The inner system or the inner shell is mounted in a loose but positionally oriented manner in the exhaust manifold or the outer shell. The fixing takes place via the outer shell and the insulating material which is incorporated between the inner shell and the outer shell. The outer shell is joined to the inlet flange and the guide plate, in particular is welded circumferentially. The gas-tightness of the exhaust manifold is established as a result of this. Thermal expansions of the system are compensated for by way of the mounting of the inner shell in a manner which is floating or loose in a defined way.

The exhaust manifold according to the invention is functionally improved, of simple construction, efficient and also advantageous in terms of assembly. The interaction of inner shells, outer shell and guide plate and inlet flange and the fixing thereof relative to one another reduces thermal stresses and disadvantageous temperature influences. In particular, disadvantageous temperatures are avoided on the outer shell which forms the load-bearing and gas-tight shell of the system, as a result of which the durability of the exhaust manifold overall is increased. In addition, the gas-tightness of the system is ensured in a reliable and simple way, without complicated gasket devices being required. Furthermore, as a consequence of its configuration and its construction, the exhaust manifold permits a design with a reduced weight.

According to the invention, the inner shell and the outer shell are positioned relative to one another via the guide plate. The inner shell is configured integrally from two shell parts. The inner shell is plugged loosely onto the guide plate or onto the positioning elements of the guide plate and is mounted in a floating manner relative to the guide plate and the outer shell. There is a circumferential gap, in order to compensate for thermal expansions. The inner shell is held in position by way of the insulating material, in particular a bearing mat between the inner shell and the outer shell, and is pressed onto the guide plate in the direction of the inlet flange.

The exhaust manifold according to the invention has a simple construction with an improved function. The number of components is reduced. Fewer individual parts mean less assembly and manufacturing complexity. Overall, an inexpensive exhaust manifold is realized by way of the embodiment according to the invention.

One aspect of the invention provides that the positioning elements are configured as guiding members which are formed on the guide plate on the circumferential side of the inflow openings. In particular, the positioning elements are configured in the form of eyelets or collar-shaped protuberances integrally from or on the guide plate in a manner which is formed from the same material. In particular, the positioning elements are of socket-shaped configuration.

The inner shell has shell regions of complementary configuration with respect to the positioning elements. As a result, the pluggability is assisted while ensuring a relative movability of the inner shell with respect to the guide plate. One particularly advantageous refinement provides that each shell part of the inner shell has shell regions which are adapted to the positioning elements, those shell regions of the shell parts which belong to one another complementing one another in each case to form an inflow port of the inner shell. When the inner shell is plugged onto the guide plate, the inflow ports engage around the positioning elements of socket-shaped configuration in a positively locking but displaceable manner, with the result that thermally induced movements can be compensated for.

One advantageous refinement of the guide plate provides that it has an outer flange which is bent over in the direction of the outer shell, and the outer shell engages around the flange. This is advantageous in terms of assembly and manufacturing. The outer shell can be plugged onto the guide plate and is positioned by way of the flange. Furthermore, an advantageous and gas-tight integral joining is possible.

A further advantageous refinement provides that at least one welded opening is provided in the edge of the outer shell. During joining, the outer shell is welded circumferentially to the inlet flange. Simultaneous welding to the guide plate takes place here via the welded openings, the welded openings being closed during the welding operation.

A further aspect provides that the outer shell has formed recesses which protrude into the region between two inflow openings. The formed recesses serve to position the structural components relative to one another and form cutouts or passages for assembly work.

The welding joining is assisted if a groove which is circumferential at a spacing from the outer edge of the guide plate is provided in the inlet flange. Here, the spacing is greater than the wall thickness of the outer shell. During the production of the exhaust manifold, the guide plate which is also called an assembly plate among those skilled in the art is first of all fixed on the inlet flange. Subsequently, the inner shell is plugged onto the positioning elements on the guide plate. The insulating material is then positioned on the inner shell. In particular, the insulating material is a single-piece or multiple-piece insulating mat body which is adapted to the outer contour of the inner shell and the inner contour of the outer shell. The insulating material has insulating as well as elastic properties. The outer shell is then plugged onto the arrangement comprising inner shell and insulating material and engages with its inlet flange-side edge around the guide plate. The arrangement is then joined together. Here, the outer shell is joined to the inlet flange and the guide plate, in particular is welded circumferentially.

Modern exhaust systems can also be equipped, inter alia, with an exhaust gas recirculation means. In this context, the exhaust manifold according to the invention is equipped correspondingly and has a connector for a pipe component of the exhaust gas recirculation means in its inner shell and its outer shell.

Figure 2:
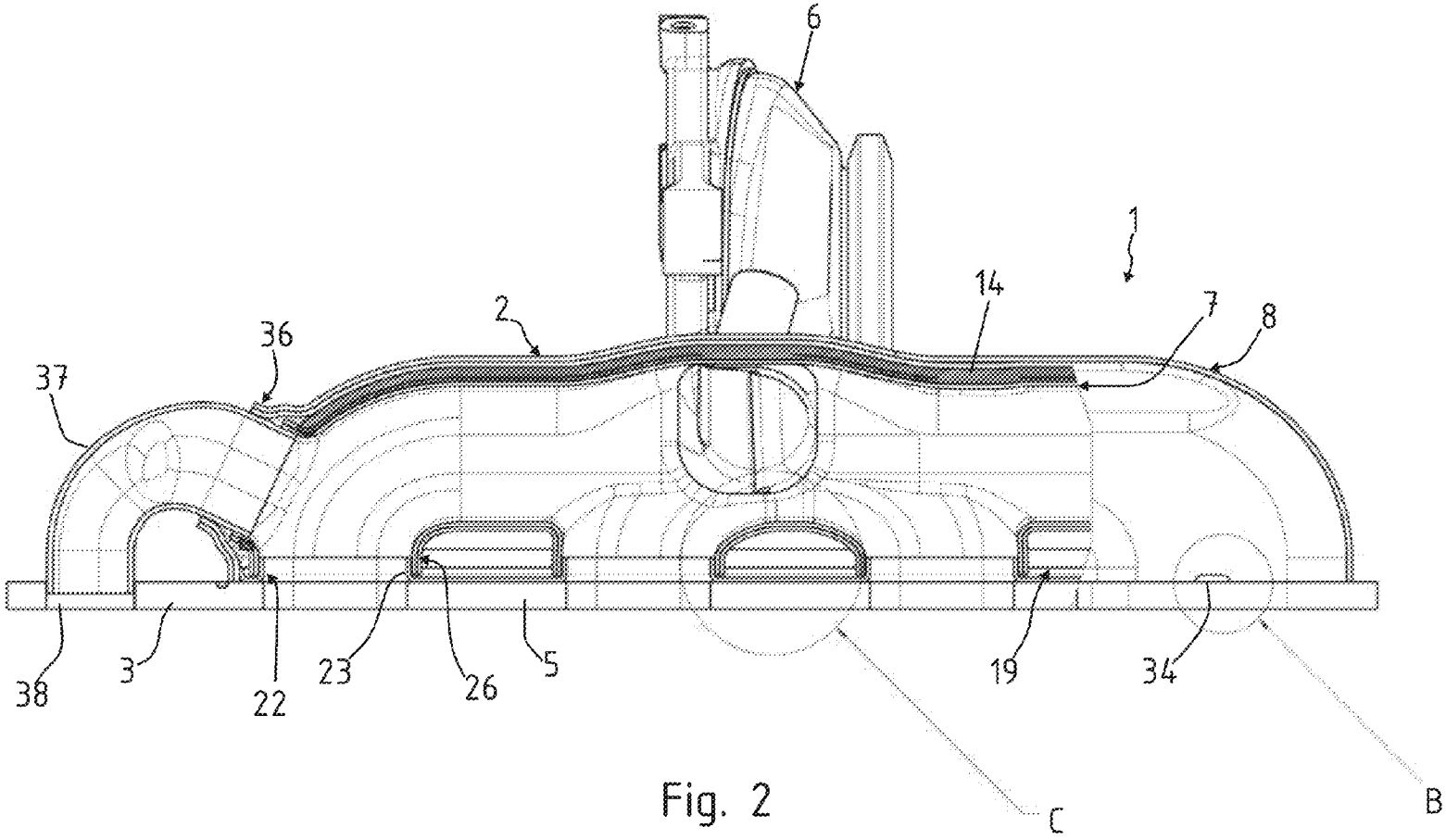
Figure 3:
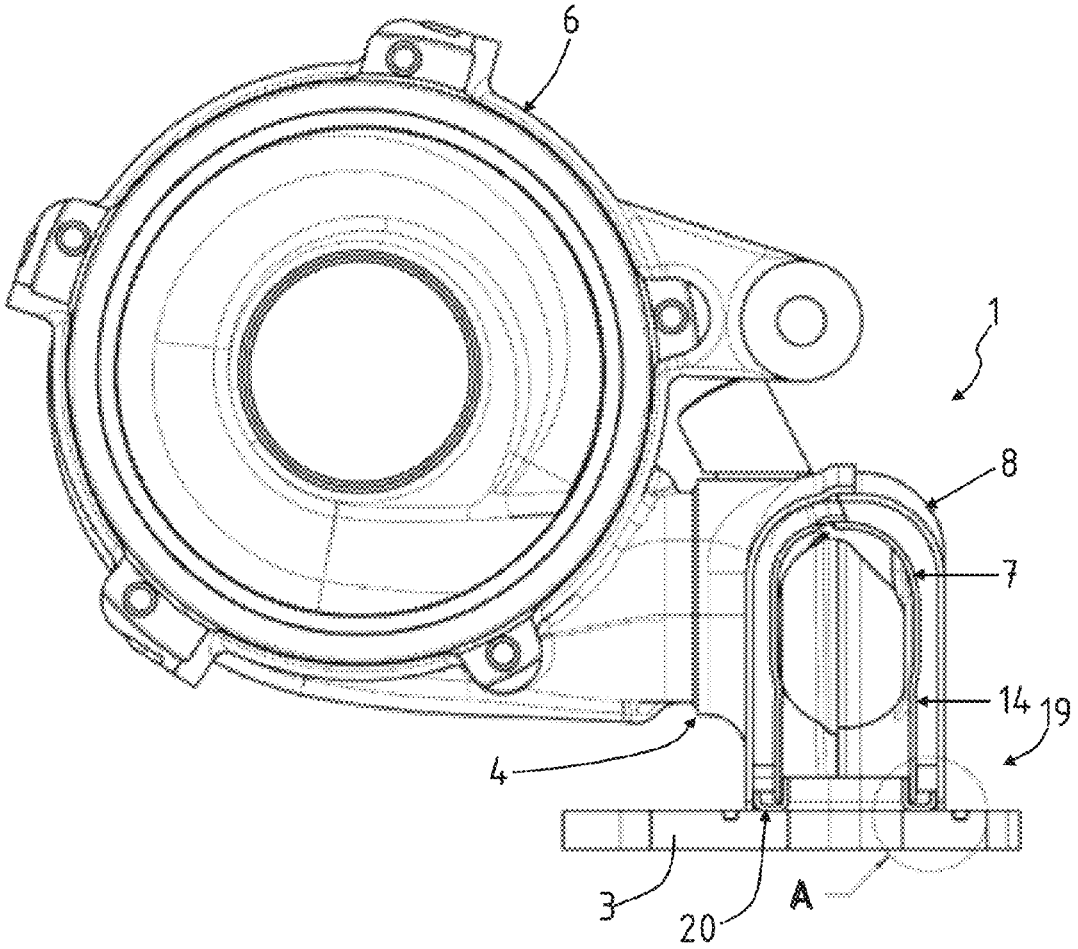
Figure 4:
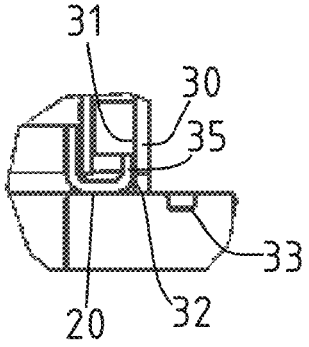
Figure 5:
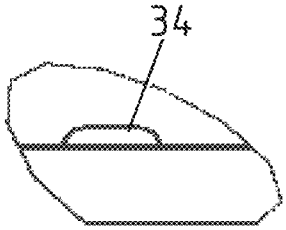
Figure 6:
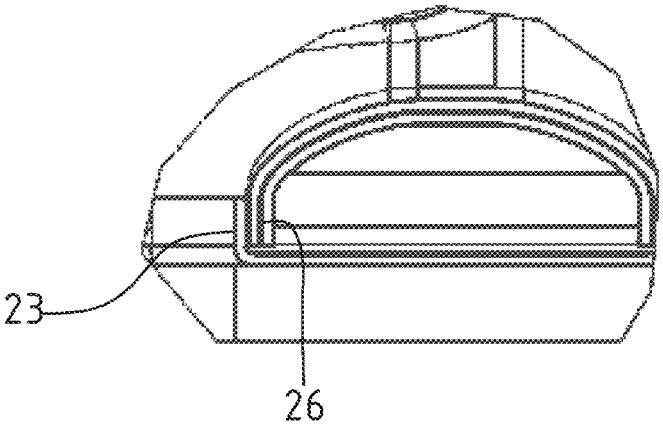
Figure 7:
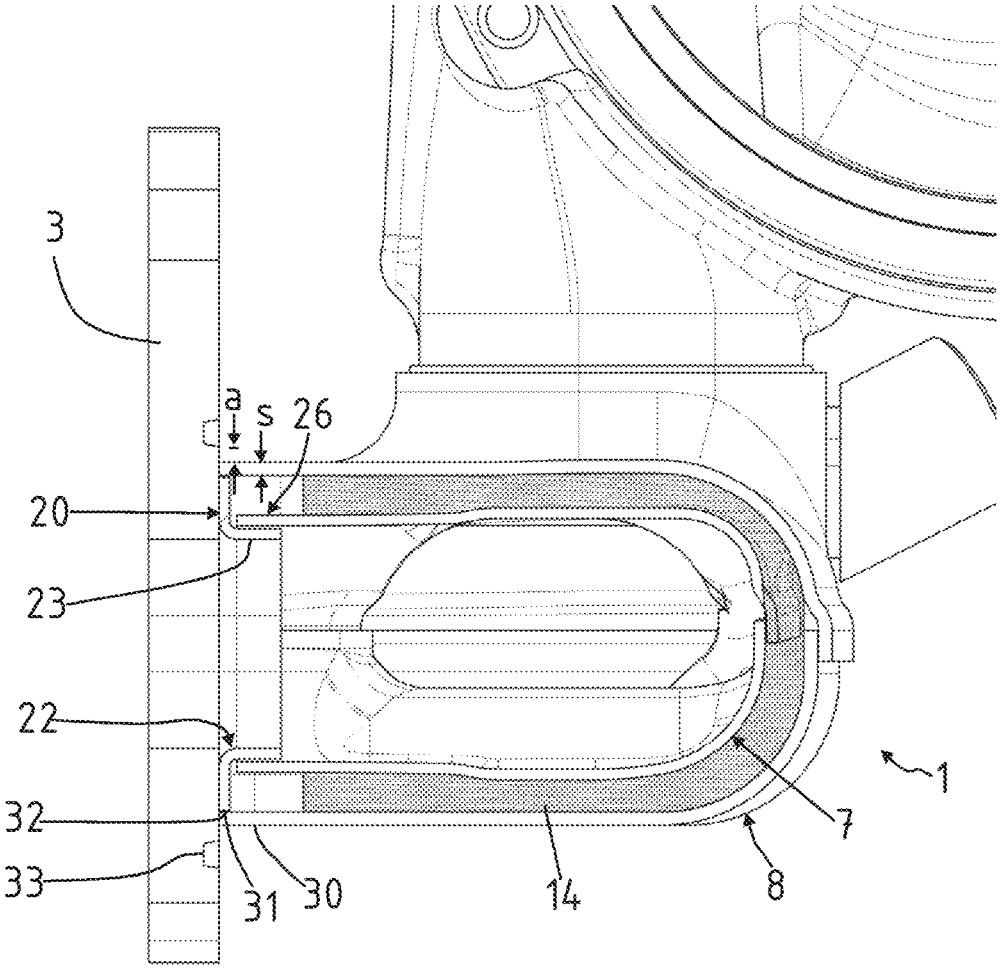

The invention is described in greater detail in the following text using exemplary embodiments which are shown in the drawings, in which:

FIG. 1 shows the exhaust manifold with an exploded illustration of its essential components, FIG. 2 shows the exhaust manifold in a side view, partially in a longitudinal section, FIG. 3 shows the exhaust manifold in a view according to the arrow III, once again in a partially sectioned illustration, FIG. 4 shows an enlarged illustration of the detail A from FIG. 3, FIG. 5 shows an enlarged illustration of the detail B from FIG. 2, FIG. 6 shows an enlarged illustration of the detail C from FIG. 2, and FIG. 7 shows a vertical cross section through a further embodiment of an exhaust manifold.

An exhaust manifold 1 according to the invention for an exhaust system of an internal combustion engine is described using the illustrations of FIGS. 1 to 6. FIG. 7 shows a modification of the exhaust manifold 1. The exhaust manifold 1 can be fixed to a cylinder head (not shown here) of an internal combustion engine in a motor vehicle.

The exhaust manifold 1 comprises a housing 2 with an inlet flange 3 and an exhaust outlet 4. The mounting of the exhaust manifold 1 on the cylinder head of the internal combustion engine takes place via the inlet flange 3. The inlet flange 3 has a plurality of inlet openings 5, via which the exhaust gas which exits from the individual cylinders is transferred into the exhaust manifold 1. The exhaust gas is fed via the exhaust outlet 4 to downstream components of the exhaust system, for example an exhaust gas turbocharger 6 as shown here.

The housing 2 comprises an inner shell 7 and an outer shell 8. The inner shell 7 consists of two shell parts, namely an upper shell 9 and a lower shell 10. The outer shell 8 is also assembled from two shell parts, namely an upper shell 11 and a lower shell 12. The shell parts 9, 10 and 11, 12 of the inner shell 7 and the outer shell 8 are connected to one another at their edges which overlap one another in each case, usually joined using welding technology.

The outer shell 8 surrounds the inner shell 7 with the formation of a gap 13. An insulating material 14 is incorporated in the gap 13. The insulating material 14 is provided in the form of a hood element 15. The hood element 15 is adapted configuratively on the outer side to the inner contour of the outer shell 8 and on the inner side to the outer contour of the inner shell 7.

The exhaust outlet 4 is formed by an outlet port 16 in the upper shell 9 of the inner shell 7 and an outlet port 17 in the upper shell 11 of the outer shell 8. The insulating material 14 which is incorporated between the inner shell 7 and the outer shell 8 or the hood element 15 has a through opening 18 which is adapted configuratively to the outlet ports 16, 17. The outlet port 16 of the inner shell 7 engages through the through opening 18 and protrudes as far as into the outlet port 17 of the outer shell 8.

A guide plate 20 is provided on the side 19 which faces the inlet flange 3, that is to say on the inlet flange side of the inner shell 7 and the outer shell 8. The guide plate 20 has inflow openings 21. The inflow openings 21 correspond with the inlet openings 5 in the inlet flange 3. Positioning elements 22 in the form of socket-shaped eyelets or sockets 23 which are formed on the guide plate 20 are configured on the circumferential side of the inflow openings 21. The positioning elements 22 serve to position the inner shell 7 in the housing 2 relative to the guide plate 20 and to the outer shell 8. Furthermore, the positioning elements 22 act as guiding members for the exhaust gas which comes from the cylinder outlets, flows in via the inflow openings 21 and is collected in the interior of the inner shell 7.

The positioning elements 22 are formed in or on the guide plate 20 integrally and from one piece. This can advantageously take place during the production of the inflow openings 21. Here, the positioning elements 22 are formed in a socket-shaped manner or as sockets 23 in the manner of an eyelet from the plane of the guide plate 20. The positioning elements 22 are flared inward into the housing 2.

The inner shell 7 has shell regions 24, 25 of complementary configuration with respect to the positioning elements 22. The shell regions 24, 25 of the upper shell 9 and lower shell 10 which complement one another form inflow ports 26 of the inner shell 7. The inner shell 7 is plugged by way of the inflow ports 26 onto the positioning elements 22 of the guide plate 20 and engages around said positioning elements 22 in a positively locking but positionally displaceable manner. The insulating material 14 holds the inner shell 7 in position, but nevertheless allows mechanical or thermal length changes without disadvantageous stresses occurring.

The outer shell 8 or the upper shell 11 and the lower shell 12 of the outer shell 8 has/have formed recesses 27. The latter protrude into the region between two inflow openings 21. The accessibility of the lower mounting openings 28 in the inlet flange 3 is realized by the formed recesses 27 in the lower shell 12. Further mounting openings in the inlet flange 3 are designated by 29.

During the manufacture of an exhaust manifold 1, the guide plate 20 is joined at the inlet flange 3. Subsequently, the inner shell 7 is placed onto it and is positioned via the positioning elements 22. Afterward, the insulating material 14 is laid or placed around the inner shell 7. The hood element 15 comprising the insulating material 14 has, as has already been stated, a configuration which is adapted to the inner contour or outer contour of the outer shell 8 or the inner shell 7, respectively. The insulating material 14 has both sound absorbing and thermally insulating properties.

The outer shell 8 is placed over the arrangement comprising guide plate 20, inner shell 7 and insulating material 14. With its edge 30 which is directed toward the inlet flange 3, that is to say the inlet flange-side edge 30, the outer shell 8 is placed over the guide plate 20 and engages around the latter. Here, the inner wall 31 of the edge 30 bears against the outer edge 32 of the guide plate 20. Subsequently, the outer shell 8 is joined to the inlet flange 3 and the guide plate 20. This takes place by way of welding. Here, the join is made circumferentially around the outer shell 8. A circumferential groove 33 which is arranged at a spacing a from the outer edge 32 of the guide plate 20 is provided in the inlet flange 3. As FIG. 3 and FIG. 7 show, the spacing a is greater than the wall thickness s of the outer shell 8. The groove 33 is provided in order to assist the welded joining between the inlet flange 3 and the outer shell 8.

Furthermore, welded openings 34 which are distributed on the circumference are provided in the edge 30 of the outer shell 8. The guide plate 20 is also welded in said regions to the inlet flange 3 and the outer shell 8 via the welded openings 34 during the welding operation. The welded openings 34 are closed in a gas-tight manner during the welding operation.

The inner shell 7 is held in position by the insulating material 14 and is pressed in the direction of the inlet flange 3 in interaction with the outer shell 8.

FIG. 3 and the detailed illustration of FIG. 4 show that the guide plate 20 has an outer flange 35 which is bent over in the direction of the outer shell 8. The flange 35 is engaged around by the edge 30 of the outer shell 8 or the outer shell 8 is plugged with its edge 30 over the flange 35. The inner wall 31 in the region of the edge 30 of the outer shell 8 bears against the flange 35 on the outside. Subsequently, the outer shell 8 is welded to the inlet flange 3 and the guide plate 20. The flange 35 assists stable holding and joining of the outer shell 8 to the guide plate 20 and the inlet flange 3.

In that design variant of the exhaust manifold 1 which is shown in FIG. 7, the outer edge 32 of the guide plate 20 butts obtusely against the inner wall 31 of the outer shell 8. Otherwise, the illustration corresponds to the above-described embodiment of the exhaust manifold 1.

Furthermore, the inner shell 7 and the outer shell 8 also have a connector 36 for a pipe component 37 of the exhaust gas recirculation means. The pipe component 37 is incorporated between the connector 36 and an opening 38 in the inlet flange 3.

LIST OF DESIGNATIONS

1—Exhaust manifold
2—Housing
3—Inlet flange
4—Exhaust outlet
5—Inlet opening
6—Exhaust gas turbocharger
7—Inner shell
8—Outer shell
9—Upper shell of 7
10—Lower shell of 7
11—Upper shell of 8
12—Lower shell of 8
13—Gap
14—Insulating material
15—Hood element
16—Outlet port of 7

17—Outlet port of 8
18—Through opening
19—Side of 7, 8
20—Guide plate
21—Inflow opening
22—Positioning element
23—Socket
24—Shell region
25—Shell region
26—Inflow port
27—Formed recess
28—Mounting opening
29—Mounting opening
30—Edge of 8
31—Inner wall of 30
32—Outer edge of 20
33—Groove
34—Welded opening
35—Flange
36—Connector
37—Pipe component
38—Opening
a—Spacing
s—Wall thickness of 8

The invention claimed is:

1. An exhaust manifold for an exhaust system of an internal combustion engine having a cylinder head, comprising:

a housing, an inlet flange configured to be attached to the cylinder head of the internal combustion engine, said inlet flange having a plurality of inlet openings and an exhaust outlet, the housing further comprising an inner shell and an outer shell, an insulating material disposed between the outer shell and the inner shell, a guide plate disposed on an inlet flange side of the inner shell and the outer shell, the guide plate has inflow openings which correspond with the inlet openings of the inlet flange and is joined to the inlet flange, the outer shell having an inlet flange-side edge and engages around the guide plate, wherein the outer shell is joined to the inlet flange and the guide plate, the guide plate having positioning elements for positioning the inner shell, the inner shell being mounted in a floating manner relative to the guide plate and the outer shell, and wherein the inner shell is held in position by the insulating material and is pressed in interaction with the outer shell onto the guide plate in a direction of the inlet flange.

2. The exhaust manifold as claimed in claim 1, wherein the positioning elements are configured as guiding members which are formed on the guide plate on a circumferential side of the inflow openings.

3. The exhaust manifold as claimed in claim 1, wherein the positioning elements are of socket-shaped configuration.

4. The exhaust manifold as claimed in claim 1, wherein the inner shell has shell regions of complementary configuration with respect to the positioning elements.

5. The exhaust manifold as claimed in claim 1, wherein the guide plate has an outer flange which is bent over in a direction of the outer shell, and the outer shell engages around the flange.

6. The exhaust manifold as claimed in claim 1, wherein at least one welded opening is provided in the edge of the outer shell.

7. The exhaust manifold as claimed in claim 1, wherein the outer shell has formed recesses which protrude into the region between two inflow openings.

8. The exhaust manifold as claimed in claim 1, wherein a groove which is circumferential at a spacing from the outer edge of the guide plate is provided in the inlet flange.

9. The exhaust manifold as claimed in claim 8, wherein the spacing is dimensioned to be greater than the wall thickness of the outer shell.

10. The exhaust manifold as claimed in claim 9, wherein the inner shell and the outer shell have a connector for a pipe component for providing exhaust gas recirculation.

11. The exhaust manifold as claimed in claim 10, wherein the inner shell has inflow ports, and the inner shell is plugged with the inflow port onto the positioning elements of the guide plate and engages around them in a positively locking but positionally displaceable manner.

* * * * *